United States Patent [19]

Lotfallah

[11] 3,966,336

[45] June 29, 1976

[54] BALL TYPE MARKER CONSTRUCTION WHICH ELIMINATES STICK-SLIP PHENOMENA

[75] Inventor: Lotfi H. Lotfallah, Hollywood, Calif.

[73] Assignee: The Gillette Company, Santa Monica, Calif.

[22] Filed: May 20, 1974

[21] Appl. No.: 471,435

[52] U.S. Cl. ..... 401/209; 401/199

[51] Int. Cl.[2] ..... B43K 7/10; B43K 5/00

[58] Field of Search ..... 401/209–217, 401/198, 199

[56] References Cited

UNITED STATES PATENTS

| | | | |
|---|---|---|---|
| 2,654,108 | 10/1953 | Scelsi | 401/211 |
| 3,474,703 | 10/1969 | Davis et al. | 401/198 X |
| 3,572,954 | 3/1971 | Cheron | 401/209 X |
| 3,592,552 | 7/1971 | Malm | 401/199 X |

FOREIGN PATENTS OR APPLICATIONS

| | | | |
|---|---|---|---|
| 248,282 | 7/1966 | Austria | 401/209 |
| 1,509,356 | 12/1967 | France | 401/209 |

*Primary Examiner*—Lawrence Charles
*Attorney, Agent, or Firm*—Poms, Smith, Lande & Glenny

[57] ABSTRACT

This application relates to ball point type of writing and marking instruments and improvements therein whereby problems involving stick-slip phenomena and skipping, uneven writing and inability to write on greasy surfaces, as well as susceptibility to shock and distruption of continuity in writing are corrected by cooperating elements involving use of feeder rods, and utilization of flexed resilient filaments to modify friction relationships between the writing ball, its seat and a writing surface.

5 Claims, 2 Drawing Figures

BALL TYPE MARKER CONSTRUCTION WHICH ELIMINATES STICK-SLIP PHENOMENA

For a number of practical reasons, makers of ball point writing instruments have desired to use low viscosity inks having an aqueous base as a vehicle, the reasons including the high intensity and laydown of such inks; such inks generally have a viscosity below about 1000 centipoises instead of the usual 10,000–20,000 centipoises. The usual viscous inks employed in ball point pens sometimes require centrifuging of the cartridge and point to establish a continuous ink column supplying the ball with ink, and sometimes even require pressurization of the ink supply in the cartridge during writing in order to permit continued uniform writing. As with all ball point inks, when those having a low viscosity and an aqueous base are used, the instruments are not always dependable, uniform writers may skip in writing, suddenly stop or appear to run out of ink, and may not be "grease writers" since they will not write on sebum-contaminated papers. Even when a trace is obtained, it may not maintain uniformity in width or intensity, and may starve out during fast writing. In addition to these deficiencies, the instruments are susceptible to physical shock such as tapping or impact from a drop upon a hard surface, which most often interrupts their ability to write for an indefinite period.

This invention is based upon the discovery that the various deficiencies of ball point writing instruments in which aqueous low viscosity inks have been tried, were mostly due to stick-slip phenomena involving frictional relationships between the ball and its metallic seat in the tip. The present invention utilizes the flexure of resilient ink-responsive filaments in feeder rods having a stated relationship with the back of the writing ball, the modify frictional relationships between the ball, its seat and the writing surface, and to accomplish a concurrent solution to all of the problems hereinabove referred to.

Some of the problems referred to herein have existed for many years. The formation of an "air lock" in an ink column leading to the back of a writing ball was recognized over 20 years ago in U.S. Pat. No. 2,594,083, but the use of a suction cap as there suggested is unsatisfactory and uneconomical. When high viscosity inks are employed, the problem can be minimized by subjecting the cartridges to centrifuging, but this entails time, labor and expense.

The present invention has for one of its objects the provisions of means which employ a new method of operation in a simple and efficient manner. Another object is to provide means whereby unique forces are employed to render ball point writing instruments free from stick-slip phenomena and thereby insure continued uniform writing, without starvation.

Commercially successful ball point writing instruments should be able to write uniformly during slow or rapid writing, with a uniform trace, and without starvation. They should start writing upon contact with paper and leave a continuous trace even upon sebum-contaminated paper. Irritating interruptions in the supply of ink from the reservoir to the ball point should not occur. For economic and other considerations, these desirable characteristics should be obtained without resorting to roughened surface balls, pressurizing devices or dependence upon writing pressure.

The present invention is directed to these problems and provides means, as well, for modifying the frictional relationships of the writing ball with respect to its seat when the ball is subjected to writing pressure, the means employed for this purpose utilizing the expansion characteristics of synthetic polymeric filamentary materials, and the development of yielding pressures capable of being used in the manners hereinafter described to produce a yielding compliant pressure against the writing ball during writing and simultaneously insure a constant flow and supply of ink to the ball.

One of the objects of the present invention therefore is to utilize the expansion characteristics and resiliency of the polymeric fibers of a feeder rod to modify the frictional relationship affecting the rotating ball of a writing instrument.

Another object is to disclose and provide means which cooperate to insure an improved functioning assembly in a ball point pen employing low viscosity inks, generally having an aqueous solution as a vehicle or base.

Another object is to disclose and provide improvements and modifications of components and elements of a ball point writing instrument whereby discontinuation of ink feed to the ball from a reservoir when the instrument is subjected to shock is eliminated.

It is also an object of the present invention to disclose a sequence of operations whereby the various parts and elements employed are positioned and maintained in effective operating relation even though the instrument is subjected to physical shock.

A still further object of the present invention is to disclose and provide means which cooperate to insure an improved functioning assembly in a ball point pen, particularly one which employs a low viscosity ink having an aqueous solution base, a smooth metal ball and does not rely on writing pressure to pressurize the ink.

Other advantages and objectives of the present invention will become apparent from a more detailed discussion of certain exemplary embodiments and procedures. In order to facilitate understanding reference shall be had to the appended drawings in which.

Figure 1:
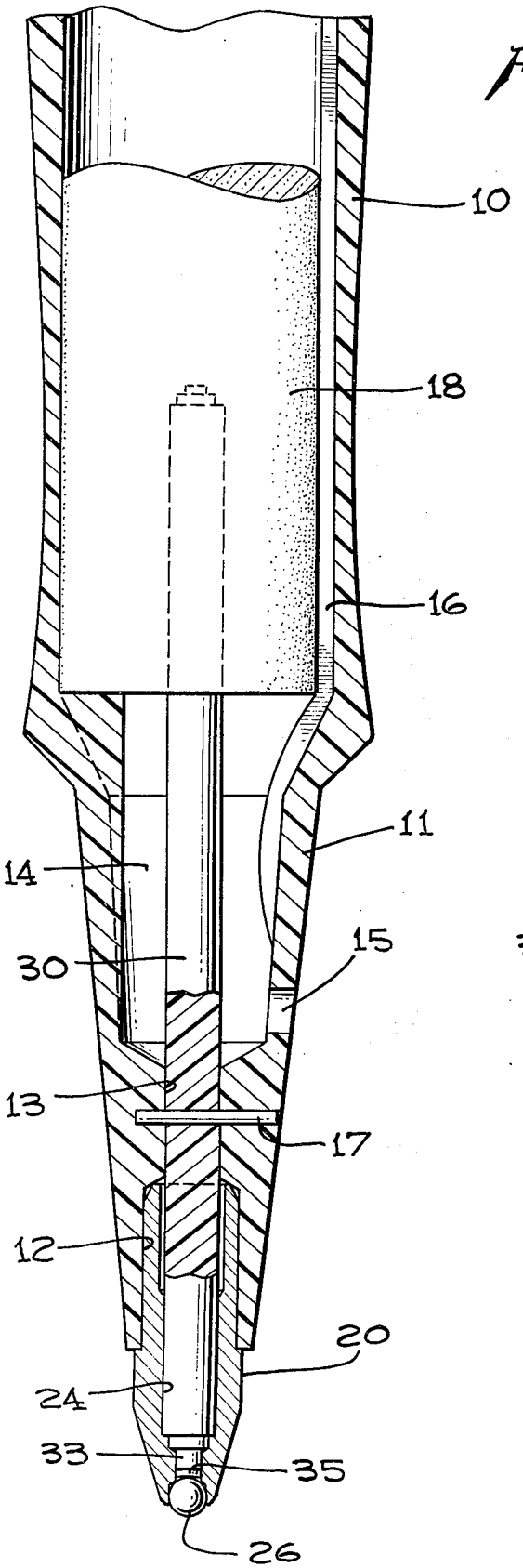
FIG. 1 is a longitudinal axial section through the forward portion of a writing instrument including the essential components of this invention.

As shown in the drawings, the writing instrument includes a barrel portion 10 having a reservoir chamber which may contain an absorbent or porous ink reservoir filler 18 of fibrous or other material. The rear end of the barrel 10 is normally closed with a plug or plume not shown. The forward portion of the barrel 10 may be tapered as indicated at 11 and the front end of such tapered portion 11 is preferably provided with a cavity 12 adapted to receive and hold by a press fit a metallic writing tip 20. The bottom of the cavity 12 is provided with a rearwardly extending central bore 13 of smaller diameter than said cavity, said bore leading to an air chamber 14. An air vent 15 is formed in the wall of the forward portion 11 surrounding the chamber 14 and suitable means such as spaced ribs or channel 16 are usually provided to convey air to the rear of the reservoir 18.

The metallic writing tip 20 which is press-fitted into the cavity 12 of the front portion 11 of the barrel of the instrument is provided with a customary ball socket 21 and a ball seat 22 in the form of a spherical zone, the seat being provided with rearwardly extending broached channels. Methods of forming the socket and its seat are shown in prior patents, such as U.S. Pat. Nos. 2,775,026 and 2,646,761. It is to be understood that in accordance with normal practice, the lip of the socket is swaged or spun around the ball so as to leave a suitable gap between such lip and the ball surface. Moreover, the ball is permitted to have desired axial movement under writing pressure, with respect to the lip, so as to deposit a trace of density, width or weight.

However, attention is called to the fact that although the usual ball point writing tip is provided with a relatively long small diameter axial channel leading from the rear of the ball to the reservoir, the writing tip preferred in this invention has a very short relatively large diameter channel 23 leading rearwardly from the spherical seating zone. As more clearly shown in FIG. 2, this short axial channel 23 then enters into an even larger diameter axial channel 24, which extends throughout the length of the metallic writing tip 20. A rearwardly facing stop shoulder 25 is annularly disposed at the rear end of the short channel 23.

A porous feeder rod of bonded polymeric filamentary material is provided and indicated at 30. It is to be noted that the forward end of this feeder rod 30 is stepped so as to have an axial portion 33 capable of extending into the axial channel 23 with the end face of said axial portion 33 in desired relation to the back of a ball 26 rotatably held in the socket. The forward end of this axial portion 33 terminates in a virtually transverse contact face. It may be noted that the body of the feeder rod 30 is of larger diameter than the extension 33 and a forwardly directed stop face 34 is provided capable of abutting the rearwardly facing stop shoulder 25 of the metal tip to thereby properly position the axial end face of the rod with respect to the ball 26. The longitudinal distance between stop face 34 on rod 30 and the end transverse face of the rod assists in establishing the final position of such end face with the rear surface of the ball. In actual practice, the contact face of the feeder rod is positioned with such contact face in a plane spaced from between about −3 to −10 mil from a true plane tangential to the rear surface of the ball 26 in the socket of said tip after swelling or expansion of rod filaments.

It may be noted that the feeder rod is preferably made of virtually parallel thermoplastic filaments lightly bonded together by means of a bonding agent, or resin solution or combination of both with concurrently applied heat, as fully disclosed in U.S. Pat. No. 3,558,392. Moreover, the polymeric material employed in the filaments is preferably of a character which will expand when in contact with ink having an aqueous solution as a vehicle, carried by the reservoir 18. Polyamide fibers (such as "nylon") are satisfactory.

It is to be understood that in accordance with normal practice, the lip of the socket is swaged or spun around the ball so as to leave a suitable gap between such lip and the ball surface. Moreover, the ball is permitted to have a desired axial movement under writing pressure with respect to the lip so as to deposit a trace of desired density, width or weight.

As shown in the drawings the metallic tip 20 is press-fitted into the bore 12 of the forward portion of the plastic body, the ball 26 having been swaged into position in the socket, the forward portion of the feeder rod 30 including the forward reduced portion 33 is forced into the bore 23 and the rear portion of the feeder rod 33, which maybe may terminate in a step end similar to the forward end, is pushed into the reservoir 18 positioned within the barrel portion 10. This reservoir portion 18 may be filled with ink before or after the subassembly including the feeder rod and the metal tip is attached to the barrel. While the feeder rod 30 is urged axially forward by its contact with the reservoir, the feeder rod is staked by means of the wire 17 which is driven through the forward plastic portion of the barrel rearwardly of the metal tip. In this manner the forward end face of the feeder rod is placed into position with respect to the back of the ball 26, not only by the limiting action between stop surface 34 and shoulder 25 but also by means which connect and hold the rear portion of the rod immovable axially with respect to the body portion of the writing instrument.

Pursuant to the objects and inventions hereof, the expansion and flexure of the filamentary material of the feeder rod under the influence of the aqueous solution-type ink is utilized in eliminating stick-slip phenomena. It was discovered the use of a feeder rod alone with its end face at a positive clearance to the rear of the ball (a clearance of say 1 to 5 mil) did not alleviate the stick-slip phenonema. Although there was no discontinuity in the ink column leading to the back of the ball which will normally terminate writing when the instrument is subjected to shock, stick-slip phenomena was troublesome.

First attempts at placing the end of the rod at a slight (less than zero) clearance showed some improvement, but grease writing ability was poor. For most efficient results, the end face of the feeder rod should assume a position of negative clearance with respect to the ball after such expansion, such negative clearance being on the order of −3 to −10 mil, whereby the rod is caused to exert a yielding pressure on the rear of the ball.

Figure 2:
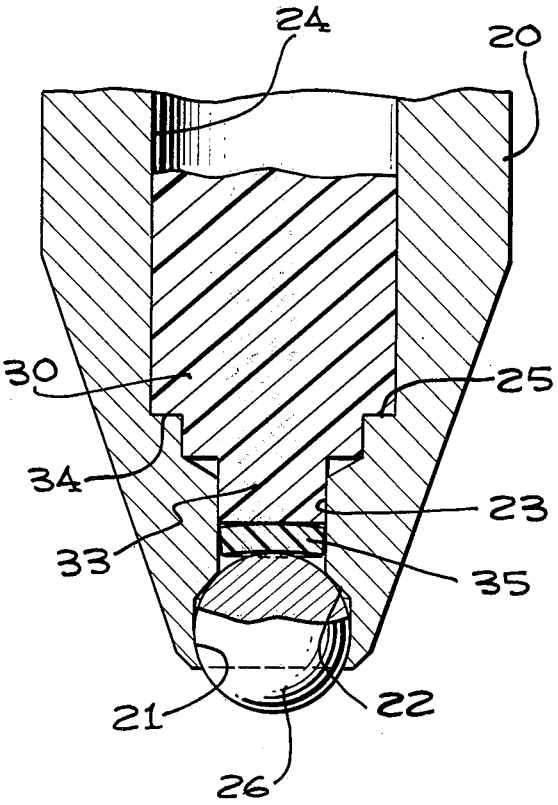
FIG. 2 is somewhat enlarged axial section of the tip portion of a writing instrument embodying the invention.

Elimination of all stick-slip phenomena and the concurrent attainment of good grease writing and resistance to shock was obtained by punching a minute disc, of a diameter equal to the diameter of channel 23, from fluorocarbon film ("Teflon") which was only 4 mil thick and pushing such disc into the channel 23 so as to trap it therein in a virtually transverse plane between the ball and the end of the rod 30 before fixing such rod in the proper position. In this manner, the force of the flexed subsequently expanded and resilient fibers of the feeder rod was transmitted through the floating and trapped disc to the ball and the stickslip phenomena was eliminated and the instrument still resisted shock and the writing ability was not disrupted when the instrument was subjected to the drop test. The position of the Teflon disc 35 is indicated in FIG. 2.

Various grades and types of Teflon and halogenated tetrafluoroethylene compositions were tried, and all of them appear to be effective.

The construction disclosed herein can be used to greatest advantage in ball point instruments for use by persons desiring a trace which is not excessively fine, but which is uniform in width and intensity. In terms directed to the point of view of the manufacturer and its control testing personnel, they are advised that the pen should have a high ink "laydown" (in mg. per ft. of trace), a slightly greater axial play for the ball in its socket, and perhaps a greater gap between the metal ball and the socket lip, and an ink which may have a lower viscosity (below about 1,000 centipoises). The results of a pen made pursuant to this invention in comparison with a conventional pen are exemplified by the following tabulation:

| | Conventional | As Here |
|---|---|---|
| Ink Viscosity, cp. | 15,000 | 5 |
| Ink Laydown mg./ft. | 0.13 | 0.50 |
| Socket Diameter for 1 mm ball, mils | 39.6 | 40.0 |
| Axial Ball Play, mils | 0.7 | 1.0 |

The use of an axially perforated Teflon disc does not materially improve results. Reference made herein to the disc as being trapped in its position does not connote that such disc is immovable; instead, movement is desirable. The ink employed does not wet the disc, but should wet the surface of the metal ball.

The inks employed are preferably based on aqueous solutions which cause expansion of the polyamide (nylon) fibers used in the feeder rods. Since the nylon filaments used are usually bulked or kinked, it may be said that in the writing instrument of this invention, the writing ball is supported upon a large number of resilient springs, as comfortably as if on a spring mattress and is conducive to relaxed and comfortable writing.

I claim:

1. In a ball-type marking instrument, wherein a writing ball is rotatably held in a socket of a metallic writing tip element carried by a forward end portion of a thermoplastic composition barrel member, including a rearwardly disposed chamber including a porous reservoir containing ink having an aqueous solution base, the provision of:

means for modifying the stick-slip friction relationships between the ball and its seat while writing and of the provision of means to prevent interruption of writing ability by reason of discontinuity of ink feeding when the instrument is subject to shock, said means including a feeder rod composed of a bundle of virtually parallel polymeric filaments lightly bonded together, the rear end portion of said rod extending into the ink of said reservoir and a front end face adjacent the rear of the writing ball, the filaments of said feeder rod being adapted to expand in the presence of ink from the reservoir and to flex and exert a yielding and opposing pressure on the rear of said ball during writing with the frontal surface of said ball, and means connecting and holding at least the rear portion of said rod in normally fixed and axially immovable relation with respect to the barrel member and ball.

2. A ball point writing instrument as stated in claim 1, wherein the means includes an axial ink-conducting channel in communication with the socket for the ball, said channel having a length of between 0.5 and 0.7 of the ball diameter and a diameter not smaller than 0.3 of the ball diameter, the forward end of the feeder rod having a diameter adapted to be slidably received within such channel.

3. A method of modifying stick-slip friction relationships between a writing ball and its seat while writing, including the step of conveying low viscosity ink from a reservoir to the rear surface of a writing ball by a porous feeder rod composed of thermoplastic filamentary material capable of expanding in the presence of ink, said filamentary material being discontinuously resin bonded maintaining a rear portion of said feeder rod axially immovable at a zone remote from the rear of the ball, and allowing the frontal portion of said feeder rod to expand longitudinally under the influence of the influence of the ink and exert a yielding, compliant pressure against the writing ball during writing.

4. In a ball-type marking instrument, wherein a writing ball is rotatably held in a socket of a metallic writing tip element carried by a forward end portion of a thermoplastic composition barrel member, including a rearwardly disposed chamber including a porous reservoir containing ink having an aqueous solution base, the provision of:

means for modifying the stick-slip friction relationships between the ball and its seat while writing and of the provision of means to prevent interruption of writing ability by reason of discontinuity of ink feeding when the instrument is subject to shock, said means including a feeder rod composed of a bundle of virtually parallel polymeric filaments lightly bonded together, the rear end portion of said rod extending into the ink of said reservoir and a front end face adjacent the rear of the writing ball, a movable disk of thin fluorocarbon film trapped between the front face of the feeder rod and back of said ball, the filaments of said feeder rod being adapted to expand in the presence of ink from the reservoir and to flex and exert a yielding and opposing pressure on the rear of said ball through said disk during writing with the frontal surface of said ball, and means connecting and holding at least the rear portion of said rod in normally fixed and axially immovable relation with respect to the barrel member and ball.

5. In a ball point writing instrument including a plastic composition body portion having a rearward ink reservoir and a forwardly extending tapering hollow portion carrying a metallic writing tip, said writing tip being provided with a socket having a writing ball rotatably held therein upon a spherical zone ball seat, the provision of an axial inkconducting channel in communication with said socket, said channel having a diameter not less than 0.3 of the ball diameter and a length not exceeding said channel diameter, said channel extending rearwardly to an enlarged counterbore, and means for modifying frictional relationships of the writing ball with respect to its seat with the ball subjected to writing pressure, said means including a porous inkconducting feeder rod composed of filamentary material lightly bonded together, said rod having a rear portion extending into contact with ink having an aqueous solution base in said rearward ink reservoir and a front portion of reduced diameter extending into said axial channel and terminating in a substantially flat transverse end face, said reduced diameter axial portion slidably fitting said axial channel, said feeder rod including a stop surface adapted to cooperate with a shoulder of said metallic tip to position the end face of the rod in desired proximity to the ball in said socket, a movable disk of fluorocarbon film trapped in said channel between the ball and the front face of said feeder rod, the filamentary material of said feeder rod being adapted to expand in the presence of ink from said reservoir and exerting yielding, compliant pressure against the writing ball during writing, and means connecting and holding at least the rear portion of said rod immovable axially with respect to said body portion.

* * * * *